US006829863B2

(12) United States Patent
Lovas

(10) Patent No.: US 6,829,863 B2
(45) Date of Patent: Dec. 14, 2004

(54) DOOR JAMB PROTECTOR

(75) Inventor: Eugene P. Lovas, 14531 Golders Green Ln., Westminster, CA (US) 92683

(73) Assignee: Eugene P. Lovas, Las Vegas, NV (US)

( * ) Notice: Subject to any disclaimer, the term of this patent is extended or adjusted under 35 U.S.C. 154(b) by 0 days.

(21) Appl. No.: 10/144,442

(22) Filed: May 11, 2002

(65) Prior Publication Data

US 2003/0208962 A1 Nov. 13, 2003

(51) Int. Cl.[7] ..... E06B 1/04

(52) U.S. Cl. ..... 52/211; 52/717.01; 52/716.8; 52/717.03; 52/717.06; 49/462

(58) Field of Search ..... 52/211, 717.01, 52/800.1; 220/400; 428/166, 78, 122; 206/521

(56) References Cited

U.S. PATENT DOCUMENTS

| | | | | | |
|---|---|---|---|---|---|
| 3,410,023 | A | | 11/1968 | Anello | |
| 4,087,989 | A | | 5/1978 | Taran | |
| 4,120,441 | A | * | 10/1978 | Hurley | 206/586 |
| 4,221,411 | A | * | 9/1980 | Kawada | 293/118 |
| 4,443,508 | A | * | 4/1984 | Mehl | 428/122 |
| 4,724,548 | A | | 2/1988 | London | |
| 4,742,916 | A | * | 5/1988 | Galea | 206/586 |
| 4,768,320 | A | | 9/1988 | Weller | |
| 5,176,452 | A | | 1/1993 | Stern | |
| 5,203,130 | A | | 4/1993 | Freelove | |
| 5,373,942 | A | | 12/1994 | Weder | |
| 5,488,804 | A | * | 2/1996 | Batscher | 49/462 |
| 5,737,878 | A | | 4/1998 | Raulerson et al. | |
| 5,815,998 | A | | 10/1998 | Wamsher | |
| 5,845,804 | A | | 12/1998 | Prescott | |
| D409,902 | S | | 5/1999 | Salvucci | |
| 6,357,187 | B1 | * | 3/2002 | Haldeman | 52/211 |
| 2001/0049909 | A1 | | 12/2001 | Homolka et al. | |

* cited by examiner

*Primary Examiner*—Carl D. Friedman
*Assistant Examiner*—Nahid Amiri
(74) *Attorney, Agent, or Firm*—Eric Karich

(57) ABSTRACT

A door jamb protector has a protective sheet and four elongate spring strips that together function to protect the door jamb. The protective sheet includes a top surface and an opposing bottom surface bounded by a first longitudinal edge, a second longitudinal edge, and a pair of opposing lateral edges. The first longitudinal edge is opposite the second longitudinal edge. Each of the four elongate spring strips has a convex surface, a concave surface, a first end, and a second end. Each of the four elongate spring strips has the property of self-coiling when either the first or second end is bent back over the convex surface. Each of the four elongate spring strips is associated with the protective sheet such that the first end is generally adjacent to the first longitudinal edge, the second end is generally adjacent to the second longitudinal edge, and the four elongate spring strips are generally parallel to each other.

10 Claims, 2 Drawing Sheets

DOOR JAMB PROTECTOR

CROSS-REFERENCE TO RELATED APPLICATIONS

Not Applicable

STATEMENT REGARDING FEDERALLY SPONSORED RESEARCH

Not Applicable

BACKGROUND OF THE INVENTION

1. Field of the Invention

This invention relates generally to door jamb protectors, and more particularly to a door jamb protector that can be removably attached to a door jamb with self-coiling spring strips.

2. Description of Related Art

The prior art teaches rectangular pieces of material that include self-coiling spring strips for biasing the material either towards a flat configuration or a coiled configuration.

For example, Prescott, U.S. Pat. No. 5,845,804, teaches a insulator apparatus for a beverage container. The insulator apparatus of Prescott teaches a small rectangle of foam rubber having embedded therein two spring strips positioned laterally down the length of the rectangle, as opposed to laterally across the width of the rectangle. Furthermore, the Prescott apparatus is quite small, having a length that is less than the circumference of a beverage container and an even smaller width.

Another example of this type of construction is found in Weder, U.S. Pat. No. 5,373,942, which teaches a spring strip wrapping and method for using the wrapping to wrap around a floral arrangement. The wrapping includes two sheets of material having mounted therebetween one or two spring strips adapted for wrapping the material around a floral arrangement.

Additional prior art references that include spring strips include the following: Stem, U.S. Pat. No. 5,176,452 (self-closing bag), Anello, U.S. Pat. No. 3,410,023 (novelty toy), and London, U.S. Pat. No. 4,724,548 (hugging novelty device).

The prior art does teach many forms of door frame protectors, including the following:

Freelove, U.S. Pat. No. 5,203,130, teaches a door frame protector that extends around the front, rear, and inside surfaces of a jamb and door stop. The shield includes elongate front and rear inside sections of extruded plastic to engage around the frame.

Other door frame protectors include the following: Wamsher, U.S. Pat. No. 5,815,998, Weller, U.S. Pat. No. 4,768,320, Homolka et al., U.S. 2001/0049909 A1, Raulerson et al., U.S. Pat. No. 5,737,878, and Salvucci, U.S. Pat. No. D409,902.

The above-described references are hereby incorporated by reference in full.

The prior art teaches the use of self-coiling spring strips to fasten an apparatus around an object. However, the prior art does not teach the need for or the construction of a protective device that can be removably attached to a door jamb. The present invention fulfills these needs and provides further related advantages as described in the following summary.

SUMMARY OF THE INVENTION

The present invention teaches certain benefits in construction and use which give rise to the objectives described below.

The present invention provides a door jamb protector for protecting a door jamb. The door jamb protector includes the combination of a protective sheet and at least two elongate spring strips that together function to protect the door jamb. The protective sheet includes a top surface and an opposing bottom surface bounded by a first longitudinal edge, a second longitudinal edge, and a pair of opposing lateral edges. The first longitudinal edge is opposite the second longitudinal edge. Each of the at least two elongate spring strips has a convex surface, a concave surface, a first end, and a second end. Each of the at least two elongate spring strips has the property of self-coiling when either the first or second end is bent back over the convex surface. Each of the at least two elongate spring strips is associated with the protective sheet such that the first end is generally adjacent to the first longitudinal edge, the second end is generally adjacent to the second longitudinal edge, and the at least two elongate spring strips are generally parallel to each other.

A primary objective of the present invention is to provide a door jamb protector having advantages not taught by the prior art.

Another objective is to provide a door jamb protector that can easily be attached to a door jamb for protecting the door jamb, and then easily removed once it is no longer needed.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

The above-described drawing figures illustrate the invention, a door jamb protector 10 for protecting a door jamb 12. As shown in FIGS. 1–5, the door jamb protector 10 includes the combination of a protective sheet 20 and at least two elongate spring strips 30 that together function to protect the door jamb 12.

Figure 1:
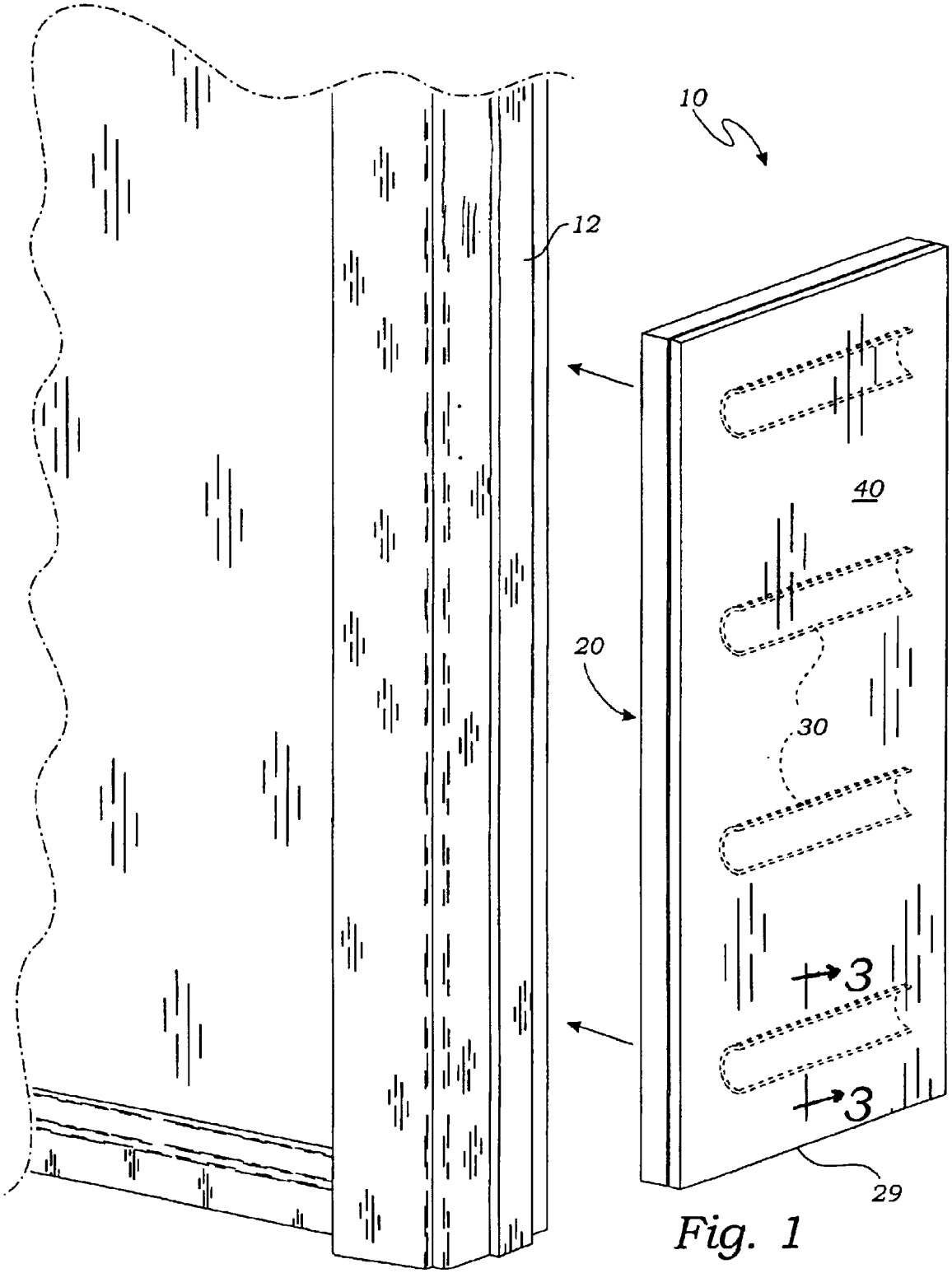
FIG. 1 is a perspective view of the preferred embodiment of the present invention, illustrating how a doorjamb protector can be positioned on a door jamb.
Figure 5:
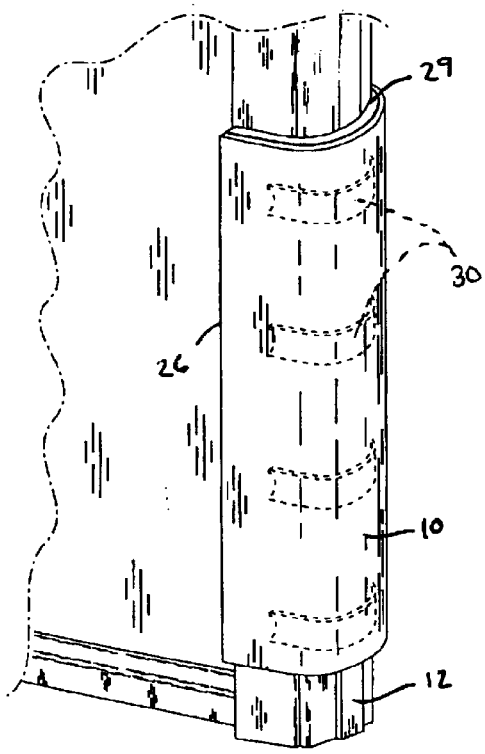
FIG. 5 is a perspective view of the door jamb protector that has been fastened onto the door jamb.

As shown in FIGS. 1 and 5, the door jamb protector 10 is sized and shaped to fit on the door jamb 12 to protect the door jamb 12 from damage. While it is preferred that only one of the door jamb protector 10 be required to protect the door jamb 12, two or more smaller door jamb protectors 10 could also be used. Furthermore, although we describe the invention as designed to protect door jambs, it will of course be understood that this should be construed to include equivalent surfaces such as corners, window frames, pillars, and other surfaces that require temporary protective padding during events such as moves, remodeling, or other similar events.

Figure 2:
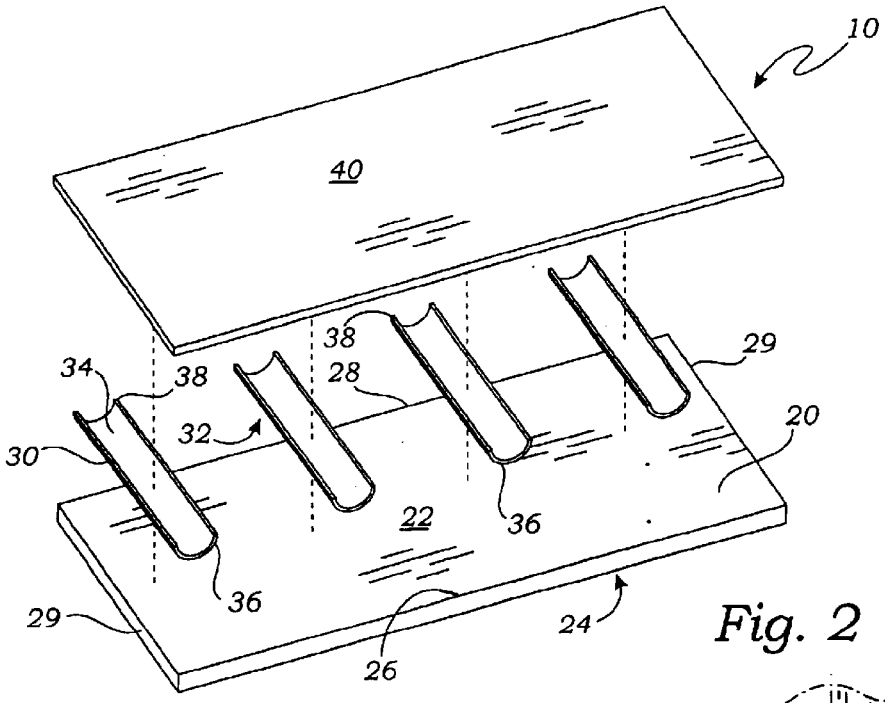
FIG. 2 is an exploded perspective view of the door jamb protector, illustrating a protective sheet and four elongate spring strips.

As shown in FIG. 2, the protective sheet 20 includes a top surface 22 and an opposing bottom surface 24 bounded by a first longitudinal edge 26, a second longitudinal edge 28, and a pair of opposing lateral edges 29. The first longitudinal edge 26 is opposite the second longitudinal edge 28. Each of the first and second longitudinal edges 26 and 28 is longer than either of the pair of opposing lateral edges 29. In the preferred embodiment, the protective sheet 20 is a generally ¼ inch thick piece of generally rectangular neoprene foam. The first and second longitudinal edges 26 and 28 are preferably each at least 18–24 inches long and the pair of opposing lateral edges 29 are preferably each at least 10–14 inches long, although larger dimensions are possible. In the most preferred embodiment, the first and second longitudinal edges 26 and 28 are preferably each 48 inches long.

Although the shape of the protective sheet 20 is preferably rectangular, other shapes could also be used as long as they are suitable for the purpose of protecting the door frame. In the case of irregular shapes, it may be difficult to define precisely which portions comprise the first longitudinal edge 26, the second longitudinal edge 28, and the pair of opposing lateral edges 29. Since it is not possible to precisely define these edges under these circumstances, the claims provided below should be construed broadly to include various shapes that may make some of the claimed edges ambiguous. For example, if the length of the protective sheet 20 is greater than its width, the first and second longitudinal edges 26 and 28 should be construed to be longer than the pair of opposing lateral edges 29, despite cutting the protective sheet 20 into various creative shapes.

Figure 3:
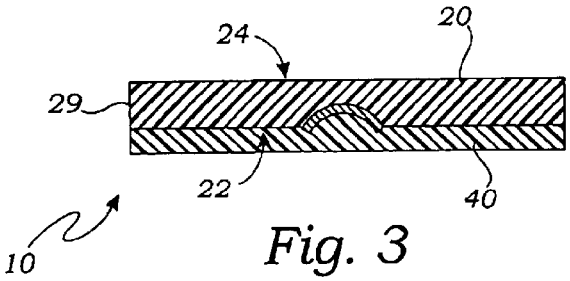
FIG. 3 is a sectional view thereof taken along line 3—3 in FIG. 1.
Figure 4:
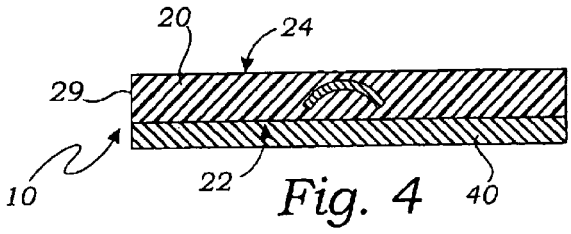
FIG. 4 is a similar sectional view of an alternative embodiment of the door jamb protector.

As shown in FIGS. 2–4, each of the at least two elongate spring strips 30 has a convex surface 32, a concave surface 34, a first end 36, and a second end 38. Each of the at least two elongate spring strips 30 is constructed of spring steel, preferably 1085–1087, and most preferably 1086 spring steel that is 0.058 mm thick, 1 inch wide, and 12 inches long. As shown in FIG. 5, each of the at least two elongate spring strips 30 has the property of self-coiling when either of the first or second ends 36 or 38 is bent back over the convex surface 32. This property is discussed in greater detail in Prescott, cited above and incorporated by reference in full.

In the preferred embodiment, the at least two elongate spring strips 30 include at least three elongate spring strips 30, most preferably at least four. By including four or more of the elongate spring strips 30, the door jamb protector 10 is better able to grip the door jamb 12 and maintain itself securely in place despite being repeatedly bumped while in use. Since the door jamb protector 10 is preferably used to protect the door jamb 12 while moving furniture, it is important that the door jamb protector 10 be securely fastened to the door jamb 12 so that it is not easily knocked out of place by the movers. Obviously, larger door jamb protectors 10 could potentially have 6–8 elongate spring strips 30, or even more if required.

As shown in FIGS. 2–4, each of the at least two elongate spring strips 30 is associated with the protective sheet 20 such that the first end 36 is generally adjacent to the first longitudinal edge 26, the second end 38 is generally adjacent to the second longitudinal edge 28, and the at least two elongate spring strips 30 are generally parallel to each other. While we describe the relationship between the at least two elongate spring strips 30 as parallel, this is meant only in the general sense, and it should not be construed to mean that the relationship be precisely and geometrically parallel. The term parallel, for purposes of this application, means only that the at least two elongate spring strips 30 are operably positioned to enable them to all self-coil around the door jamb 12, supporting each other rather than interfering with each other.

For purposes of this application, the term associated means that the protective sheet 20 moves in coordination with the movement of the at least two elongate spring strips 30. Those skilled in the art can devise many methods of associating the at least two elongate spring strips 30 with the protective sheet 20 so that the at least two elongate spring strips 30 function to removably fasten the protective sheet 20 around the door jamb 12. In one embodiment, as shown in FIGS. 2 and 3, the protective sheet 20 includes a second sheet 40 constructed of either neoprene or fabric. The at least two elongate spring strips 30 are sandwiched between the protective sheet 20 and the second sheet 40, which are bonded together with an adhesive.

In another embodiment, as shown in FIG. 4, the at least two elongate spring strips 30 are inserted into the protective sheet 20 between the top surface 22 and the bottom surface 24. It is preferred that the top surface 22 of the protective sheet 20 is still covered with the second sheet 40, but in this case the second sheet 40 is a fabric that is preferably adapted to be easily printed with advertising, decorative material, or other printed subject matter (not shown). The inclusion of the second sheet 40, in this embodiment, is not used to fasten in the at least two elongate spring strips 30 in place, but to facilitate printing.

In addition to the embodiments shown, it is also possible to associate the at least two elongate spring strips 30 with the protective sheet 20 using other techniques. For example, the at least two elongate spring strips 30 could be bonded, welded, stapled, or otherwise fastened directly to the top surface 22 or the bottom surface 24. The at least two elongate spring strips 30 could also be bonded, welded, stapled, or otherwise fastened to the second sheet 40 or other intermediary (not shown), and the intermediary could be fastened to the top surface 22 or the bottom surface 24. Obviously, those skilled in the art can devise many methods of accomplishing this association, and these various methods should be considered within the scope of the invention as claimed.

The invention includes a method for protecting a door jamb 12 using the door jamb protector 10 described above. Once each of the at least two elongate spring strips 30 has been associated with the protective sheet 20 such that the first end 36 is generally adjacent to the first longitudinal edge 26, the second end 38 is generally adjacent to the second longitudinal edge 28, and the at least two elongate spring strips 30 are generally parallel to each other, the door jamb protector 10 is ready for use.

As shown in FIG. 1, the protective sheet 20 is positioned over the door jamb 12 such that the convex surfaces 32 of the at least two elongate spring strips 30 are oriented towards the door jamb 12. The first and second ends 36 and 38 of each of the at least two elongate spring strips 30 are then pushed towards the door jamb 12, thereby causing the at least two elongate spring strips 30 to self-coil around the door jamb 12, as shown in FIG. 5, and thereby removably fasten the doorjamb protector 10 around the doorjamb 12.

Once the doorjamb protector 10 has been fastened to the doorjamb 12, or equivalent surface, it is possible to engage in activity around the door jamb 12 without damaging the door jamb 12. For example, movers could carry furniture through the door without marring the door jamb 12. In the event that the furniture bangs against the door jamb 12, the protective sheet 20 will absorb the impact and prevent either denting or scratching. The at least two elongate spring strips 30 fasten to the door jamb 12 with enough strength so that the door jamb protector 10 is not easily dislodged from its position. In the event that it is knocked off, or if the mover wants to reposition the door jamb protector 10, it is simple to open the door jamb protector 10 to the open configuration, as shown in FIG. 1, and reposition the door jamb protector 10 on another surface, or simply store the doorjamb protector 10 for future use.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A method for protecting a door jamb, the method comprising the steps of:

providing a door jamb protector having a protective sheet associated with at least two elongate spring strips such that the protective sheet moves in coordination with the at least two elongate spring strips, each of the at least two elongate spring strips having a convex surface and a concave surface;

positioning the protective sheet over a door jamb such that the convex surfaces of the at least two elongate spring strips are oriented towards the door jamb; and pressing the first and second ends of each of the at least two elongate spring strips towards the door jamb, thereby causing the at least two elongate spring strips to self-coil around the door jamb and thereby removably fasten the protective sheet around the door jamb.

2. The method of claim 1 wherein the at least two elongate spring strips include at least three elongate spring strips.

3. The method of claim 1 wherein the at least two elongate spring strips include at least four elongate spring strips.

4. A method for protecting a doorjamb, the method comprising the steps of:

providing a protective sheet having a top surface and an opposing bottom surface bounded by a first longitudinal edge, a second longitudinal edge, and a pair of opposing lateral edges, wherein the first longitudinal edge is opposite the second longitudinal edge, providing at least two elongate spring ships, each of the at least two elongate spring strips having a convex surface, a concave surface, a first end, and a second end; and associating each of the at least two elongate spring strips with the protective sheet such that the first end is generally adjacent to the first longitudinal edge, the second end is generally adjacent to the second longitudinal edge, and the at least two elongate spring strips are generally parallel to each other.

5. The method of claim 4 further comprising the steps of:

positioning the protective sheet over a door jamb such that the convex surfaces of the at least two elongate spring strips are oriented towards the door jamb; and pressing the first and second ends of each of the at least two elongate spring strips towards the door jamb, thereby causing the at least two elongate spring strips to self-coil around the door jamb and thereby removably fasten the protective sheet around the door jamb.

6. The method of claim 4 wherein each of the first and second longitudinal edges is longer than either of the pair of opposing lateral edges.

7. The method of claim 4 wherein the first and second longitudinal edges are each at least 18 inches long and wherein the pair of opposing lateral edges are each at least 10 inches long.

8. The method of claim 4 wherein the first and second longitudinal edges are each at least 24 inches long and wherein the pair of opposing lateral edges are each at least 14 inches long.

9. The method of claim 4 wherein the at least two elongate spring strips include at least three elongate spring strips.

10. The method of claim 4 wherein the at least two elongate spring strips include at least four elongate spring strips.

* * * * *